US005633557A

United States Patent [19]

Lindsay

[11] Patent Number: 5,633,557

[45] Date of Patent: May 27, 1997

[54] ANTI-FOULING SPARK PLUG

[76] Inventor: Maurice E. Lindsay, 114 Standard St., El Segundo, Calif. 90245

[21] Appl. No.: 502,527

[22] Filed: Jul. 14, 1995

Related U.S. Application Data

[63] Continuation-in-part of Ser. No. 169,211, Dec. 20, 1993, abandoned, which is a continuation-in-part of Ser. No. 951,819, Sep. 28, 1992, abandoned.

[51] Int. Cl.[6] ..... H01T 13/00

[52] U.S. Cl. ..... 313/143; 313/127; 313/138; 313/141

[58] Field of Search ..... 313/141, 138, 313/143, 145, 127, 123

[56] References Cited

U.S. PATENT DOCUMENTS

| | | | |
|---|---|---|---|
| 2,028,971 | 1/1936 | Falor | 313/138 |
| 3,229,032 | 1/1966 | Willis | 313/145 |
| 3,870,918 | 3/1975 | Senda et al. | 313/143 |
| 3,958,144 | 5/1976 | Franks | 313/143 |
| 4,110,667 | 8/1978 | Graf Vom Hagen | 313/143 |
| 4,307,316 | 12/1981 | McKechnie | 313/143 |
| 4,730,582 | 3/1988 | Lindsay | 313/143 |
| 5,128,583 | 7/1992 | Ma | 313/143 |

*Primary Examiner*—Sandra L. O'Shea
*Assistant Examiner*—Matthew J. Esserman
*Attorney, Agent, or Firm*—Jack Munro

[57] ABSTRACT

A spark plug for an internal combustion engine which has an electrode centrally mounted within an insulator with this insulator being mounted within an elongated housing. The outer end of the insulator is formed into a core nose with this core nose either being planar or mounded. Located directly adjacent the core nose and spaced slightly therefrom plus being spaced from the electrode is a ground ring. The electrical resistance is selected so that the spark will travel from the center electrode across the core nose and then jump the air gap at approximately the closest spacing distance from the ground ring and the core nose. The ground ring can be ported. The ground ring annular opening into the fire hole of the spark plug may be sawtoothed to form a mass of spark-emanating points.

3 Claims, 2 Drawing Sheets

ANTI-FOULING SPARK PLUG

This application is a continuation-in-part of patent application Ser. No. 08/169,211, filed Dec. 20, 1993, entitled ANTI-FOULING SPARK PLUG, now abandoned, which is a continuation-in-part of patent application Ser. No. 07/951,819, filed Sep. 28, 1992, entitled IMPROVED PERFORMANCE SPARK PLUG, by the same inventor, now abandoned.

BACKGROUND OF THE INVENTION

1) Field of the Invention

The field of this invention relates to an improved performance spark plug for an internal combustion engine which not only achieves increased operating efficiency but operates in a manner that substantially eliminates the fouling of the spark plug.

2) Description of Prior Art

Spark plugs are used in internal combustion engines (except diesel engines) to provide high voltage sparks that ignite the fuel/air mixture within the combustion chambers of the engine. When the engine is running, a pulse of electrical energy, at very high voltage, is delivered to the terminal of the spark plug at the correct moment by means of a spark generating device. The spark is caused to jump the gap between the center electrode and the ground electrode of the spark plug. The spark provides the energy needed to ignite the compressed fuel/air mixture in the cylinder of the engine.

It has been found that, for optimum performance, that the temperature of the core nose at the firing end of the spark plug should not drop below 400° centigrade nor exceed about 850° centigrade. Below 400° centigrade, deposits of carbon and oil are likely to accumulate. Carbon being electrically conductive, can provide a short circuit path for the high voltage pulse and so weaken or eliminate the spark. Therefore, a fouled spark plug causes incomplete burning of the fuel/air mixture and possibly may cause non-ignition of the fuel/air mixture.

A lot of effort has been expended in the past to design spark plugs in conjunction with four-cycle engines. Within a two-cycle engine, the propensity for a fouled spark plug is greater as generally a two-cycle engine runs colder.

The conventional type of spark plug utilizes a strip-type of ground electrode which overlies the tip of the center electrode. This strip assumes a slight gap from the center electrode across which the spark is to occur. This type of spark plug has but one spark presentation, that being that the spark occurs at approximately the same location each time the spark plug is operated. Any accumulations of oil or carbon, not located directly in the path of the firing of the spark plug, will remain adhered to the surface of the spark plug and will accumulate and result in inefficient usage of the spark plug.

Within recent years there have been spark plugs designed where there is not a single spark presentation but random spark presentation. Also, it has been known in the past that to have the spark presentation move across the core nose will function to keep the core nose clean and prevent accumulations of oil or carbon and actually will function to remove any accumulations of oil or carbon that may occur on the core nose.

SUMMARY OF THE INVENTION

The primary objective of the present inventions is to construct a spark plug which is usable not only within a four-cycle type of engine but within a two-cycle type of engine and which will substantially eliminate fouling of the plug and therefore decrease the amount of pollutants that are exhausted into the atmosphere while at the same time increasing the power output of the engine.

Another objective of the present invention is to construct a spark plug which produces greater horsepower than equivalent prior art plugs and produces greater output torque of the engine. Additionally, the spark plug of the present invention achieves the increased horsepower with decreased fuel consumption of the engine as well as decreased air consumption of the engine.

The spark plug of the present invention is constructed similar to a conventional spark plug in that it has a tubular housing within which is mounted an insulator and centrally mounted within the insulator is an electrode. The outer free end of the electrode terminates in a tip and the portion of the insulator directly adjacent to this tip is termed the core nose. A ground ring is integrally connected to the tubular housing and extends over, in a spaced relationship from, a portion of the core nose some preset distance spaced from the center electrode. The core nose could either be planar or it can be mounded. The spacing between the center electrode and the ground ring as well as the spacing from the ground ring to the surface of the core nose is selected so that the electrical resistance is such that the spark will travel along the surface of the core nose before jumping from the core nose to the ground ring. This travelling of the spark in a random manner on the core nose will function to keep the core nose clean of oil and carbon thereby substantially eliminating any possibility of fouling of the spark plug.

The primary objective of the present invention is to construct a spark plug which utilizes random multiple spark presentations in the operation of the spark plug so as to achieve a self-cleaning feature by ionizing any accumulation of carbon and oil on the core nose of the spark plug.

Another objective of the present invention is to construct a spark plug which causes a more complete combustion of the fuel/air mixture to occur.

Another objective of the present invention is to construct a spark plug which can be manufactured at a cost substantially close to the manufacturing of a conventional spark plug.

DETAILED DESCRIPTION OF THE SHOWN EMBODIMENT

Figure 1:
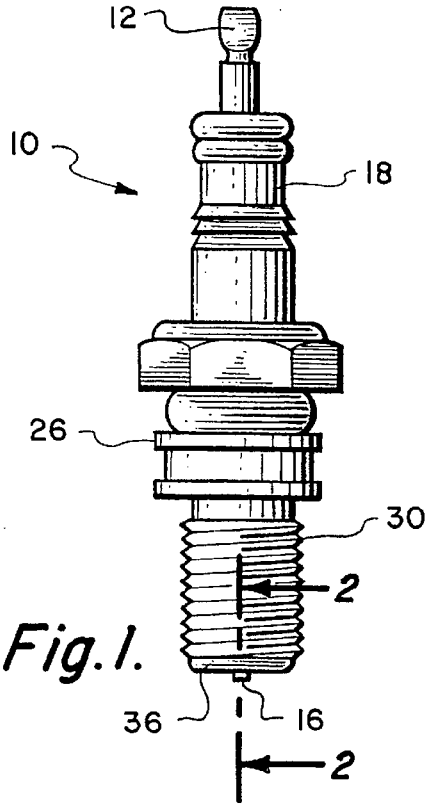
FIG. 1 is a side elevational view of the spark plug constructed in accordance with the present invention.

Referring particularly to the drawing, there is shown the spark plug 10 of this invention. The spark plug 10 has an outer upper end which is formed into a terminal 12. This terminal 12 is electrically connected to a center electrode 14. Center electrode 14 has the same transverse cylindrical cross-section throughout its longitudinal length. The center electrode terminates at the bottom of lower end into a tip 16. The tip 16 is the firing end of the spark plug 10.

Fixedly mounted onto the center electrode 14 is an insulator 18. The center electrode 14 is centrally mounted within longitudinal hole 20 formed within the insulator 18. The bottom end of the insulator 18 is formed into a planar core nose 22 shown within FIG. 2. Within FIG. 3 the core nose 24 is not planar but is of a mounded or rounded configuration.

Fixedly mounted onto the exterior wall of the insulator 18 is a tubular housing 26. Located between the insulator 18 and the housing 26 is a gas-tight seal 28. The use of such a seal 28 is deemed to be conventional within spark plug construction. A portion of the exterior surface of the housing 26 includes a series of screw threads 30. The purpose of the screw threads 30 is to facilitate mounting within a spark plug receiving hole (not shown) formed within an engine (not shown).

The core noses 22 and 24 are the portion of the insulator 18 that is located closest to tip 16. The core noses 22 and 24 form the inner closed end of a chamber defined as a fire hole 32 within FIG. 2 and fire hole 34 formed in FIG. 3. It can be seen that the fire hole 34 is of a different configuration than the fire hole 32 which is due mainly to the different shape of the core nose 24 as opposed to the planar core nose 22. The volume of the fire hole 34 is significantly greater than the volume of the fire hole 32.

The portion of the housing 26 that is located nearest the tip 16 is formed into a ground ring 36. The ground ring 36 extends inwardly toward the center electrode 14 and overlies a portion of the core nose 22 or 24 but is spaced therefrom. The ground ring 36 terminates at a sharpened point P which is circular and is centrally disposed relative to the exterior cylindrical surface C of the center electrode 14. Surface P is aligned with a wall surface of the fire hole 32 and 34 which comprises plane 38. It can be seen in comparing FIGS. 2 and 3 that in FIG. 3 the surface P is located physically nearer surface C than in FIG. 2.

Figure 2:
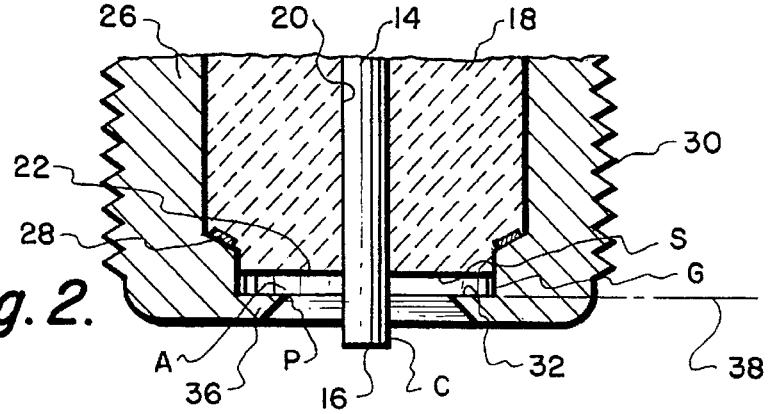
FIG. 2 is a longitudinal cross-sectional view through the firing tip end of the spark plug of the present invention taken along line 2—2 of FIG. 1 depicting the subject matter of the spark plug of this invention with a planar core nose.
Figure 3:
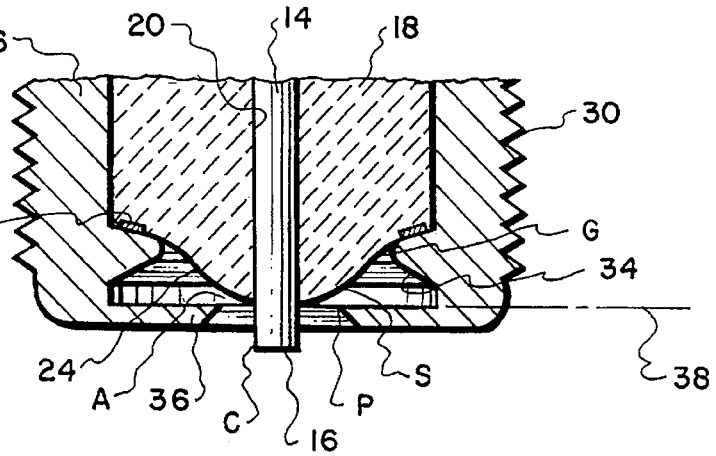
FIG. 3 is a view similar to FIG. 2 but showing a mounded core nose.
Figure 4:
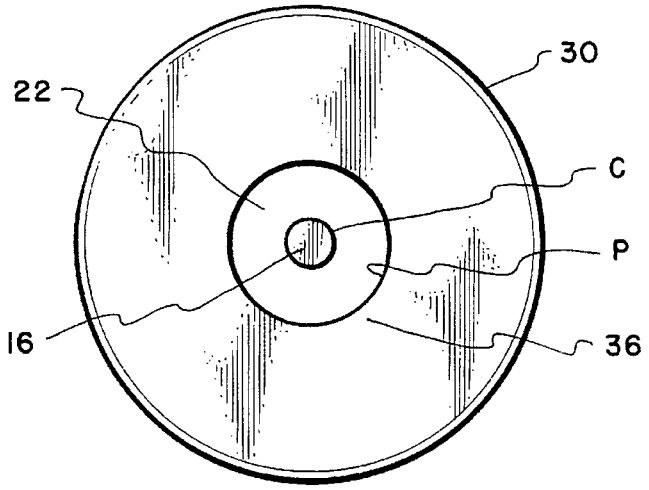
FIG. 4 is a bottom view of the spark plug of FIG. 2.
Figure 5:
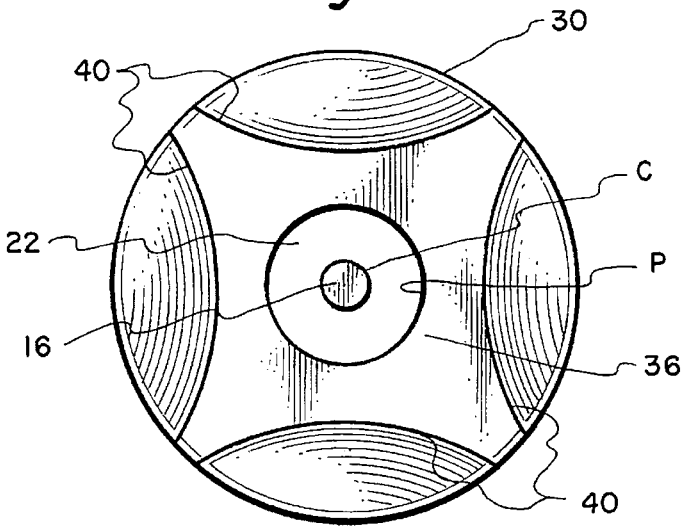
FIG. 5 is a bottom view similar to FIG. 4 but of a modified version of spark plug where the plug is vented.

It is to be noted that within FIGS. 2 and 3 the spark plug 10 that is shown is of the non-vented type of plug configuration. It is considered to be within the scope of this invention that the ground ring 36 could be modified to include a series of holes or vents which connect with the fire hole 32 or 34. It is to be understood that such venting of a spark plug is a well known practice and is deemed to be conventional. In FIG. 5 such a "vented" plug is shown where the ground ring 36 includes four (in number) of evenly spaced-apart ports 40. These ports 40 permit the combusted gas/air mixture within the fire hole 32 to be quickly injected throughout the combustion chamber (not shown) of the engine (not shown) in which the spark plug is mounted.

Figure 6:
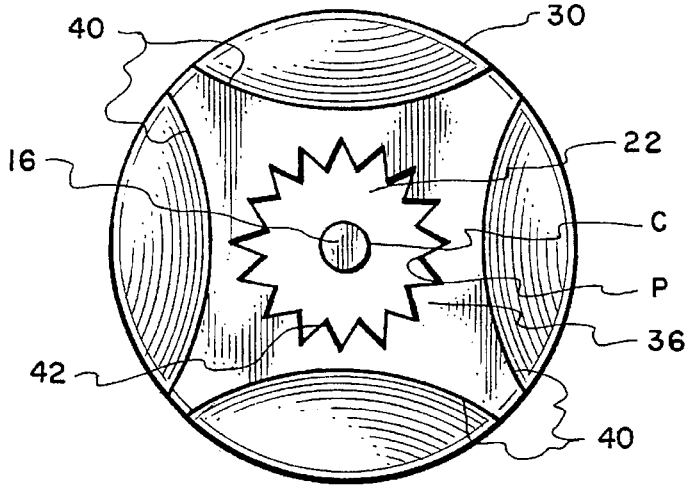
FIG. 6 is a bottom view similar to FIG. 5 but showing a further modification in shaping of the ground ring.

In FIG. 6 the configuration of the sharpened point P of the ground ring is sawtoothed, forming a mass of spark-emanating points 42. It is the function of each of the points 42 to concentrate the spark and facilitate its "jumping" across the air gap A.

The portion of the core nose 22 and 24 that is located nearest the point P is defined within this description as S. It is to be understood that S will be a circle. The distance between S and P is defined as A which is the air gap. The point where the core nose 22 and 24 connects to the housing 26 and is located directly adjacent the seal 28 is defined as G.

The plane 38 of the ground ring is shown evenly spaced from the planar surface of the core nose 22 within FIG. 2. However, in FIG. 3 this is not the case as there is a constant variation of spacing from the plane 38 and the surface of the core nose 24. Actually, the portion of the core nose 24 that joins with the center electrode 14 is in substantial alignment with the plane 38. It is to be noted that the tip 16 extends exteriorly of the plane 38 as is clearly shown in both FIGS. 2 and 3. This extension of the center electrode 14 has been found to be desirable to insure the most satisfactory conduction of the spark.

If any foreign material collects on the core nose 22 or 24, the spark will have a tendency to follow the path of least resistance and ionize and remove the deposit immediately. It is to be remembered that the foreign material will probably be some form of carbon, and since carbon is electrically conductive, it would be the path of least resistance. This removal occurs when the spark plug 10 is under load such as due to acceleration of the engine. However, normal operation of the engine will also function to remove any foreign material. Deposits on the core nose 22 and 24 normally take place during the starting and idling modes of the engine. If per chance there occur any deposits as far as G, the spark, again following the path of least resistance, will spark in that direction and result in elimination of the deposit. Therefore, it is to be understood that with utilizing the spark plug 10 of this invention that under normal operation the spark path will ionize any collection of oil and/or carbon on the entire surface of the core nose 22 and 24, as well as on the inner surfaces of the ground ring 36 and the wall of the fire hole 32 or 34.

It is to be noted that if one could observe the firing of the spark plug 10 there would be a mass of what appears to be continuous firings in all different directions (360°) from the cylindrical surface C of the center electrode 14. This means that, with the spark plug 10 of this invention, there are multiple spark presentations and not a single spark presentation which is so prevalent within prior art spark plugs.

In constructing of the spark plug 10, the following parameters will generally be followed: Distance of C to P will be within the range of 0.04 inches to 0.07 inches. Air gap A will be between the range of 0.01 to 0.03 inches. Distance of P to S will be in the range of 0.01 to 0.02 inches. Following these parameters, the electrical resistance of the distance of P to C will be greater than the electrical resistance of the distance of C to S to A to P. Also, the electrical resistance of the distance of C to S to A to P will be less than electrical resistance of the distance of C to S to G. It is to be understood that the dimensions given are arbitrary but are proven under experimentation. Available voltage, compression ratios, cylinder pressures and engine revolutions per minute dictate the selection of the dimensions for a particular installation.

The spark plug 10 of this invention has been found to resist damage from heat. The spark plug 10 of this invention is of particular advantage within the following environments: Racing, outboard motors, aircraft, trucks, autos, and heavy equipment.

In accordance to tests that have been conducted in comparing the spark plug 10 of the present invention in conjunction with prior art type of spark plugs, the following general advantages have been determined: Horsepower, between 3250 rpm and 5500 rpm, a general increase of six to seven percent. Torque, between 3250 rpm and 5500 rpm, an approximate increase of two percent. Fuel consumption, a general decrease of between five and eighteen percent with the maximum fuel consumption occurring at approximately 4500 rpm. Air consumption, there was a slight decrease of about one half percent.

What is claimed is:

1. A spark plug for producing combustion within an internal combustion engine, said spark plug comprising:

an elongated housing having a sidewall terminating in an electrical ground ring at one end, said housing being tubular forming an internal chamber, said ground ring defining an enclosing exit opening located within a plane, the inner edge of said ground ring defining said enclosing exit opening being referred to as P, P being sharpened forming a pointed circular wall;

a center electrode mounted within said internal chamber, said center electrode having a tip, said center electrode being centrally located within said exit opening, said center electrode having a constant cross-sectional configuration along its entire longitudinal length, said tip being exteriorly spaced from said plane, said tip defined by an exterior ring referred to as C, P being the portion of said ground ring closest to C;

an insulator mounted about said center electrode and within said internal chamber, said insulator terminating in a core nose directly adjacent to said tip but spaced slightly therefrom, said core nose not projecting exteriorly of said plane, the circular portion of said core nose located closest to P is referred to as S, an annular air gap referred to as A is formed between S and P; and said ground ring having an interior wall surface, a fire hole formed between said core nose and said interior wall surface, P being in alignment with said interior wall surface, P being located closer to C than said sidewall of said elongated housing at the point of connection with said core nose referred to as G, the electrical resistance of P to C being greater than the electrical resistance of C to S to A to P, P to C forming a path which is different than the path from C to S to A to P, the electrical resistance of C to S to A to P being less than the electrical resistance of C to S to G, the core nose forming a mounded surface which terminates at the plane.

2. The spark plug as defined in claim 1 wherein:

the distance of P to C being constant within a particular said spark plug, the distance of P to C being within the range of 0.04 inches to 0.07 inches.

3. The spark plug as defined in claim 2 wherein:

A is a constant distance for each particular said spark plug, A is within the range of 0.01 inches to 0.03 inches.

* * * * *